US007237924B2

(12) United States Patent
Martineau et al.

(10) Patent No.: US 7,237,924 B2
(45) Date of Patent: Jul. 3, 2007

(54) LED SIGNAL LAMP

(75) Inventors: Patrick Martineau, Lachine (CA); Eden Dubuc, Lachine (CA)

(73) Assignee: Lumination LLC, Valley View, OH (US)

( * ) Notice: Subject to any disclaimer, the term of this patent is extended or adjusted under 35 U.S.C. 154(b) by 276 days.

(21) Appl. No.: 10/461,151

(22) Filed: Jun. 13, 2003

(65) Prior Publication Data

US 2004/0252520 A1 Dec. 16, 2004

(51) Int. Cl.
*F21V 5/00* (2006.01)

(52) U.S. Cl. ..... 362/231; 362/240; 362/331; 362/246; 362/247; 362/96

(58) Field of Classification Search ..... 362/231, 362/240, 330, 331, 235, 247, 246, 800, 96, 362/309, 332–333, 335–340, 545–547, 326, 362/244; 40/550; 359/159, 742
See application file for complete search history.

(56) References Cited

U.S. PATENT DOCUMENTS 4,729,076 A * 3/1988 Masami et al. ..... 362/235
5,947,587 A 9/1999 Keuper et al.
6,054,932 A * 4/2000 Gartner et al. ..... 340/815.65
6,283,613 B1 * 9/2001 Schaffer ..... 362/245
6,599,002 B2 * 7/2003 Hsieh et al. ..... 362/555
6,970,296 B2 * 11/2005 Blumel ..... 359/641

OTHER PUBLICATIONS

U.S. Appl. No. 10/292,333, (Blumel) Signaling Device for Traffic Signals Published Apr. 23, 2003 filed Nov. 12, 2002.
WO 08/052524 (Blumel) LED-Signal Device for Traffic Lights Published Jul. 4, 2002.

* cited by examiner

*Primary Examiner*—Laura K. Tso
(74) *Attorney, Agent, or Firm*—Fay Sharpe LLP

(57) ABSTRACT

An LED signal using a novel optical element to control the light distribution of a small LED light source. Light emitted by the LEDs illuminates the optical element. The optical element has a plurality of clusters, shaped along the x-, y- and z-axis to control the light. After the light is distributed, it encounters a second optical surface of the optical element, typically a fresnel surface. The light is controlled by the optical element.

Optionally, a lens can be placed over each LED to control the light pattern of the LED. The lens has an entry face to direct the light to a total internal reflection surface on the side, which redirects the light to the exit face. The resulting signal is a uniform, efficient signal.

43 Claims, 20 Drawing Sheets

LED SIGNAL LAMP

BACKGROUND OF THE INVENTION

1. Field of the Invention

The present invention relates to signals, in particular, Light Emitting Diode (LED) Signals. More specifically, the present invention relates to LED signals using a novel optical element to control the light distribution of a small LED light source.

2. Description of the Related Art

LED signals such as LED traffic signals, present numerous advantages over incandescent lamp traffic signals. Use of LEDs provides a power consumption savings and extremely long life compared to incandescent light sources. The long life span of the LED signals leads to improved reliability and lower maintenance costs.

Due to the large number of existing incandescent traffic signals, most LED signals are designed to be retrofit into existing systems originally designed for incandescent lamps. To allow an easy retrofit without requiring significant changes to the preexisting AC power distribution and logic circuits, then LED signal assemblies typically incorporate a power supply to drive the LEDs at a lower, controlled, direct current power level.

Typical LED signals use multiple LEDs to replicate the light output of the incandescent lamp. Multiple LEDs can create a display aspect within which the individual points of light from each LED are discernable. This is undesirable. LED technology is improving. Each generation of LEDs is brighter, requiring fewer LEDs to meet the intensity specification. While fewer LEDs lowers the cost of the signal, it also increases the potential for viewing the LEDs as individual point sources and for having undesirable shadows. To combat this, the present invention utilizes a novel optical element.

Prior art LED traffic signals control the light distribution by using one of three methods: LEDs alone; by combining LEDs with a spreading or distributive cover; and most commonly by collimating the light from the LEDs and then distributing or spreading the collimated light. The spacing and placement of the LEDs is also important to controlling the light in the prior art systems as the optics of prior art systems are dependent on the spacing and placement of the LEDs.

The inventive optical element provides distribution before collimation and is more efficient than prior art methods for LEDs with wide radiation patterns. The signal of the present invention is also more flexible because all the optics are in one part. The light distribution can be changed by changing the optical element. In prior art systems having both a fresnel lens and a distributive cover/shell are used to control the light, changing the light distribution requires changing both the lens and the cover/shell. It is not necessary to also change the shell/cover.

SUMMARY OF THE INVENTION

As LEDs continue to improve, the footprint to generate sufficient light intensity will decrease. The present invention utilizes a novel optical element to control the light from the LEDs.

The present invention uses high output LEDs that are relatively small. LEDs are grouped about a central axis perpendicular to the optical element. The collimation and distribution are done with a single optical element, with the light being distributed before it is collimated. This is very efficient for wide beam LEDs. Distributing and then collimating the light is a very efficient system and generates a more uniform signal than prior art systems.

To control the light from the LEDs a molded optical element is used. The optical element has an optical surface having known properties on the side away from the LEDs and a plurality of distributive clusters on the LED side of the optical element. The optical element fully controls the light. The inventive optical element has clusters on a first surface to distribute the light from the LED and that light through a second optical surface such as a fresnel surface. Prior art signals collimate the light and then distribute the collimated light.

The first surface of the optical element has an adaptive texture. The surface comprises a plurality of clusters on the LED side of the optical element. Each cluster is a smooth surface approximating a plurality of facets. The facets and clusters are machined in the x-, y- and z-dimensions to fully control the light.

Each cluster is unique. Because the optical element distributes the light first, the angle of light incident at each location of the optical element is different and requires a different shaped cluster to control the light.

In prior art systems that collimates the light first, all the rays incident of the spreading cover are in the same direction. Thus, the identical distributive surface can be repeated over the entire spreading surface.

The distance between the LEDs and the optical element is a function of the light pattern of the LEDs. It is desirable to illuminate the entire optical element, but no more. The optical element is placed the distance from the LEDs that allows maximum illumination of the cover. If the light pattern from the LEDs is too wide, lensing optionally can be placed over the LEDs to adjust the light pattern to illuminate the optical element.

The radiation pattern of the LEDs may be different depending on the supplier. A lens may be mounted in front of each LED to change the radiation pattern. Thus, the inventive optical element can be used to control the light of various LEDs without the need to modify the optical element depending on the supplier. Optionally, a reflector could also be used, alone or in conjunction with the lens, to change the radiation pattern.

DETAILED DESCRIPTION

Figure 1:
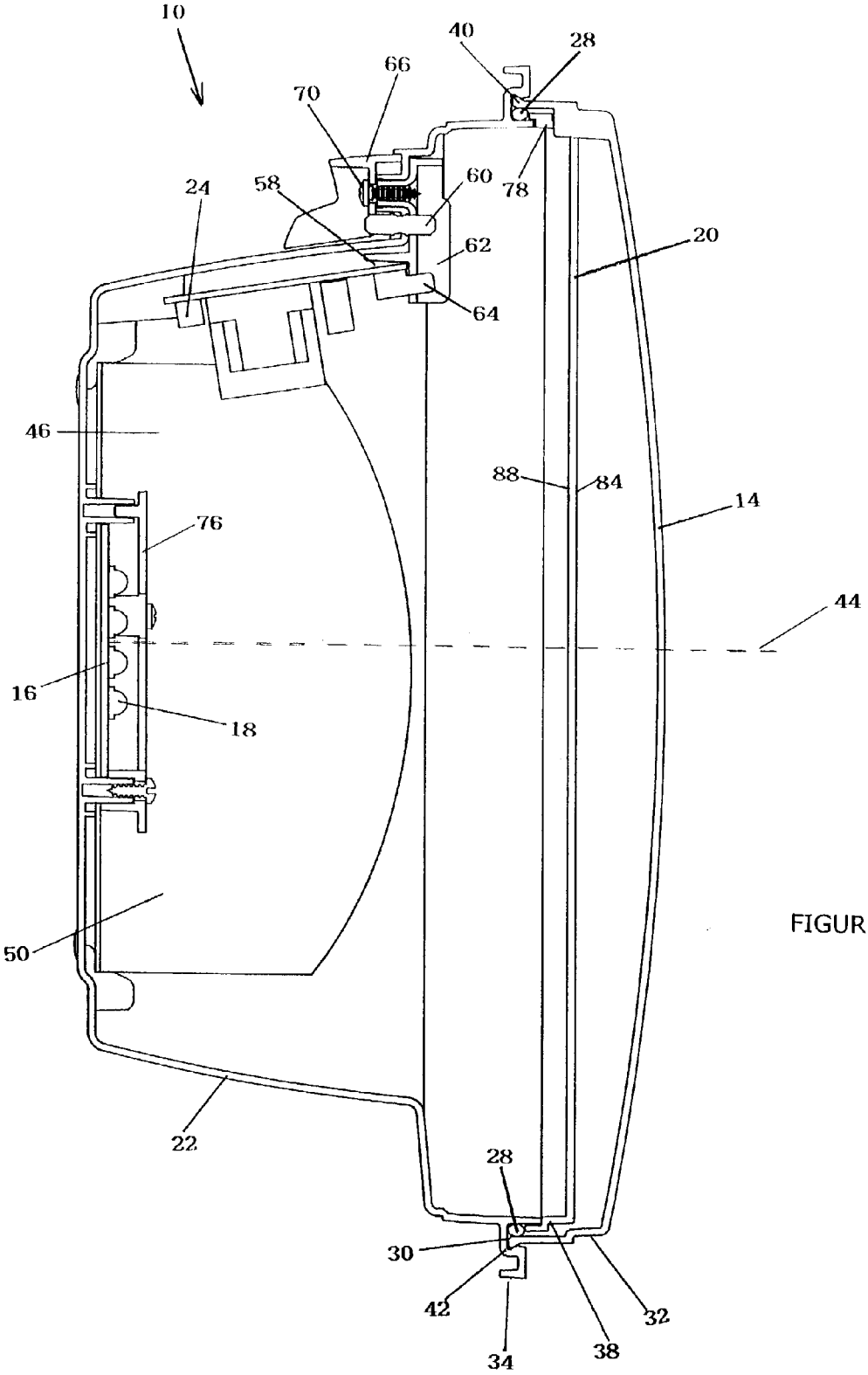
FIG. 1 is a two-dimensional cross-section signal lamp.
Figure 2:
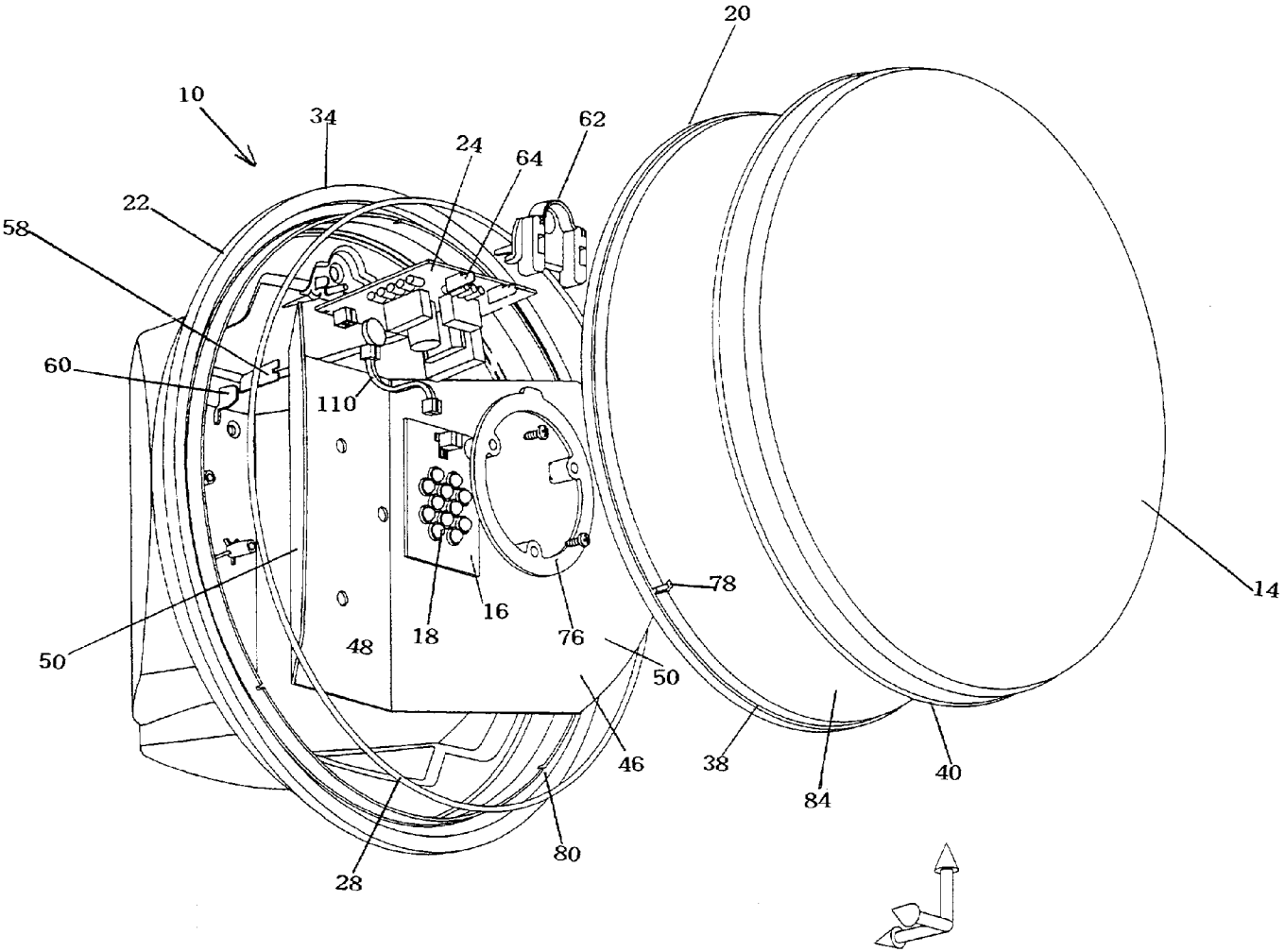
FIG. 2 is an exploded view of the signal lamp.
Figure 3:
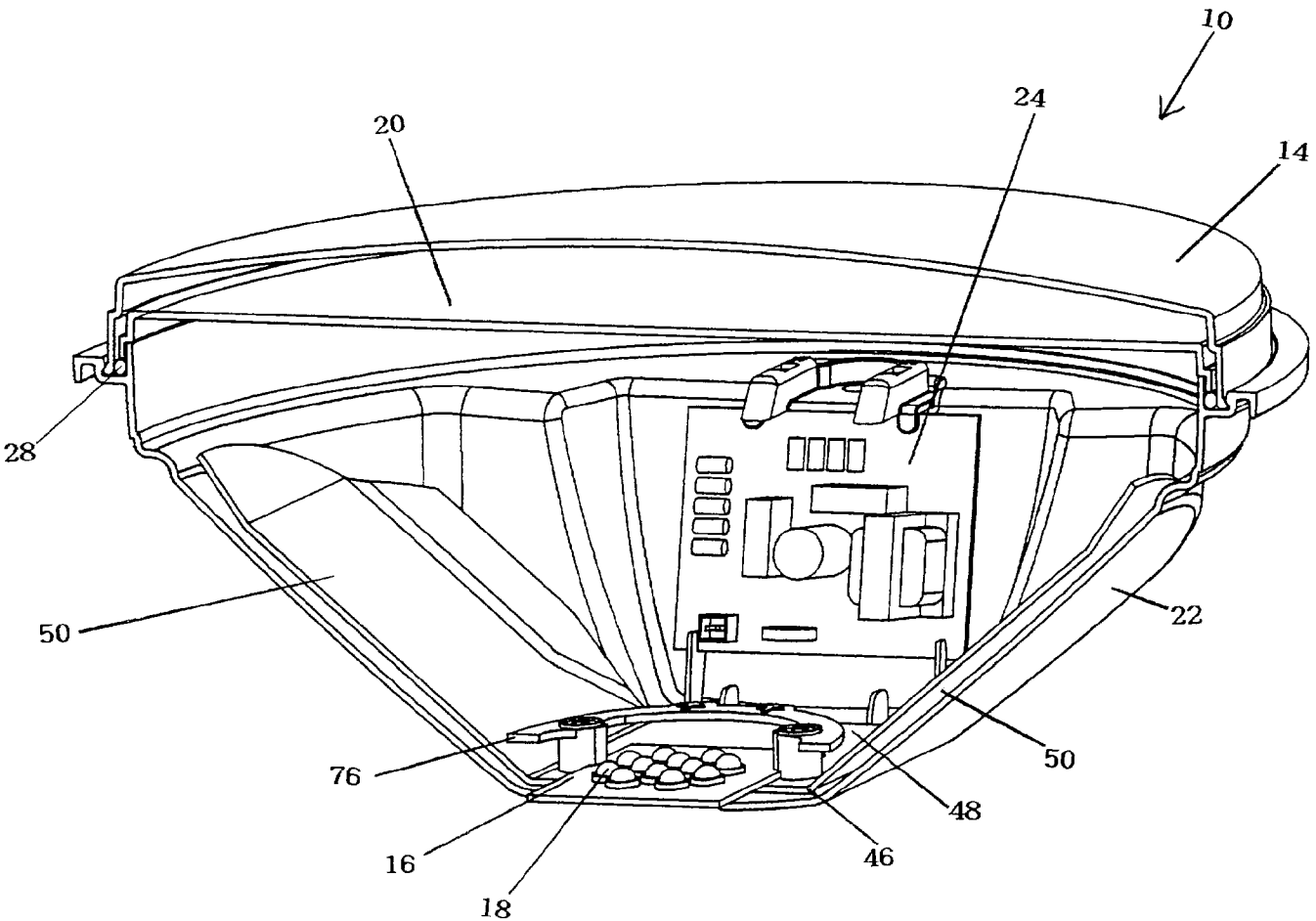
FIG. 3 is a three-dimensional cross-section of the signal lamp.
Figure 4:
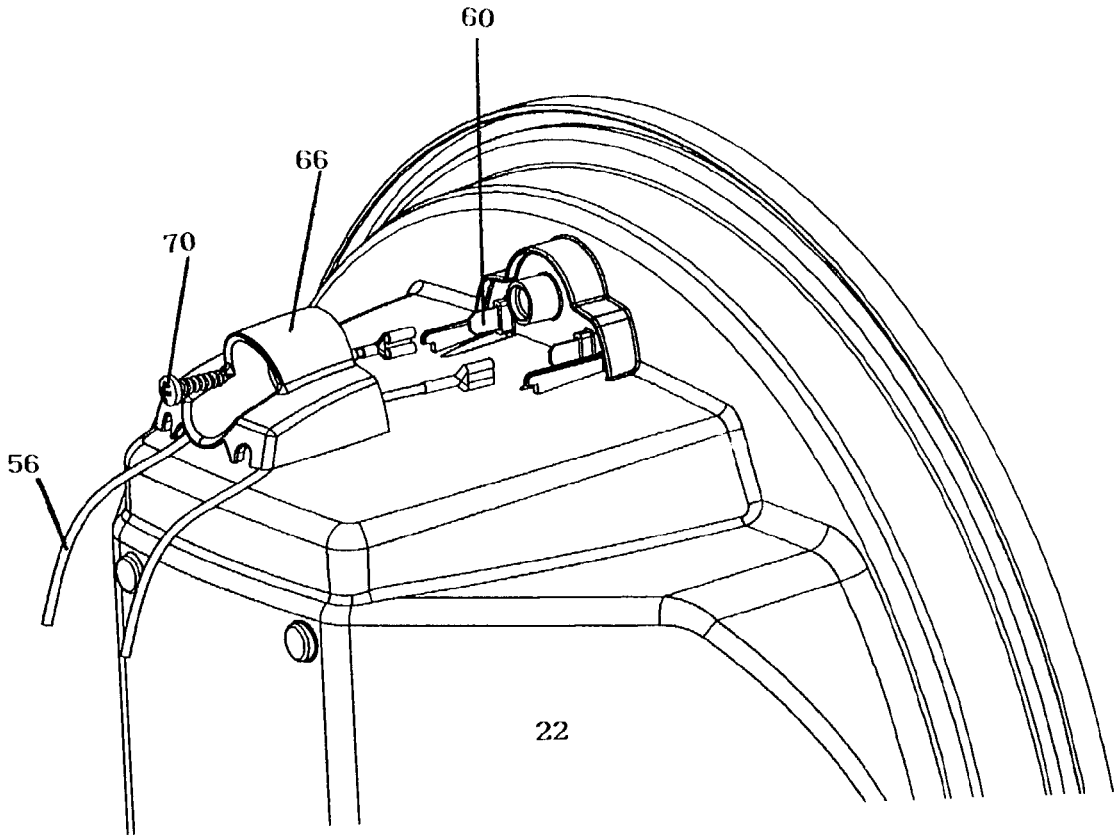
FIG. 4 is a detail view for the connection for the power supply on the housing base.
Figure 5:
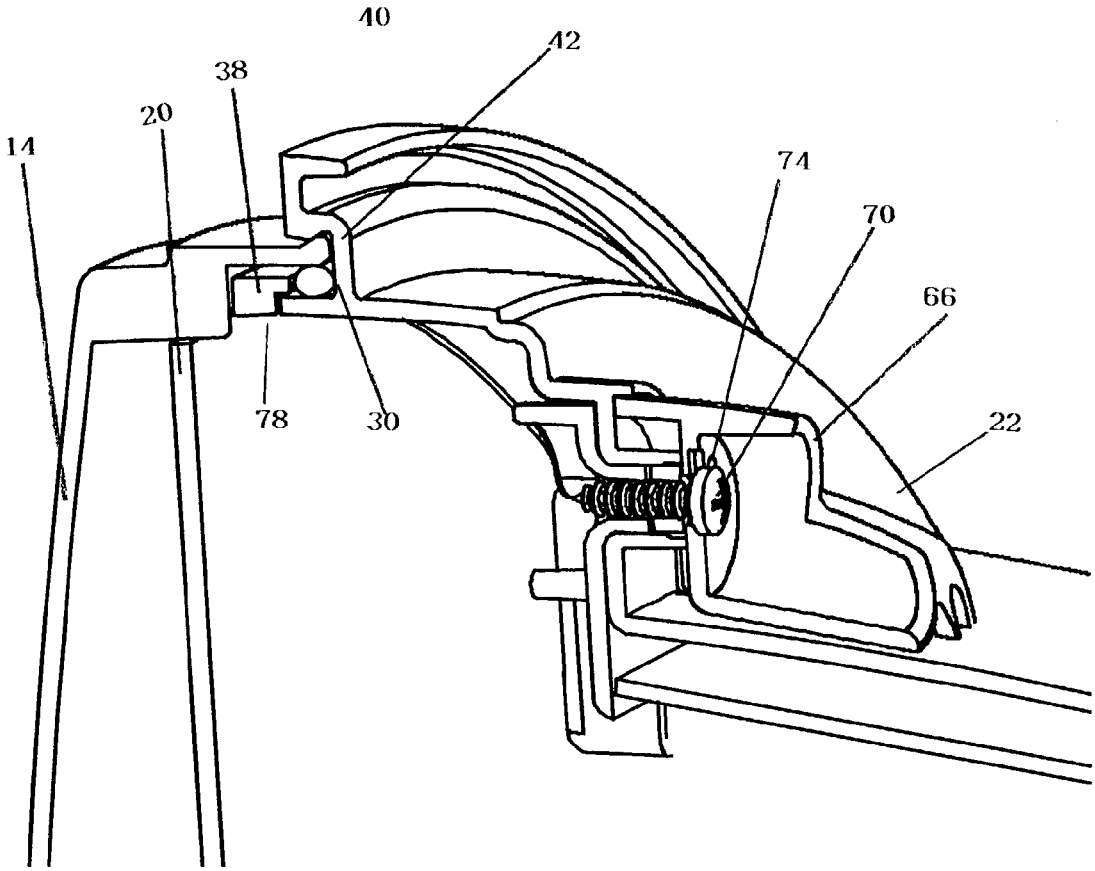
FIG. 5 is a cross-section view of the connection for the power supply on the housing base.
Figures 6, 7:
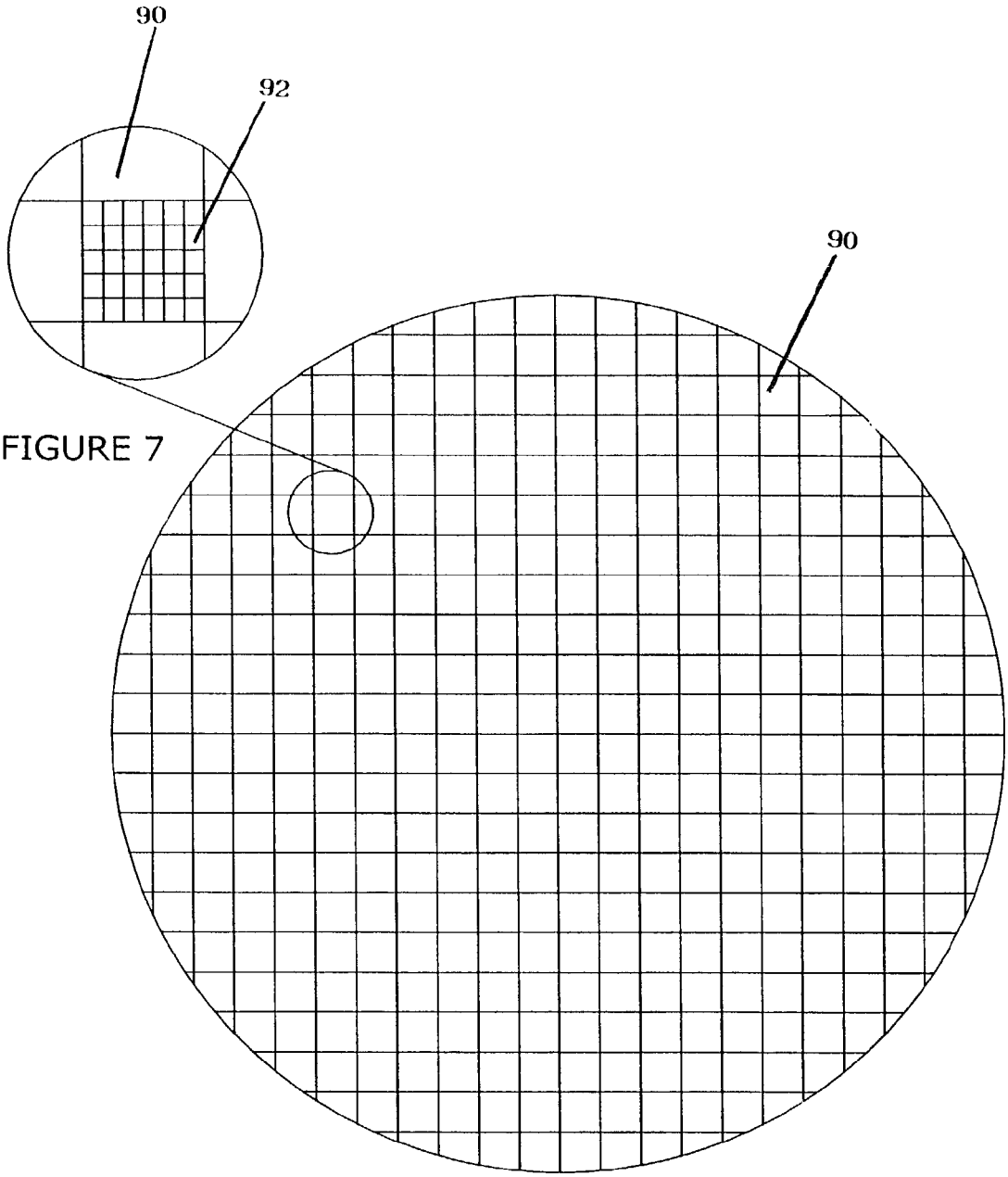
FIG. 6 is a representative view of clusters of the optical element.
FIG. 7 is a representative view of the facets in a cluster.
Figure 7A:
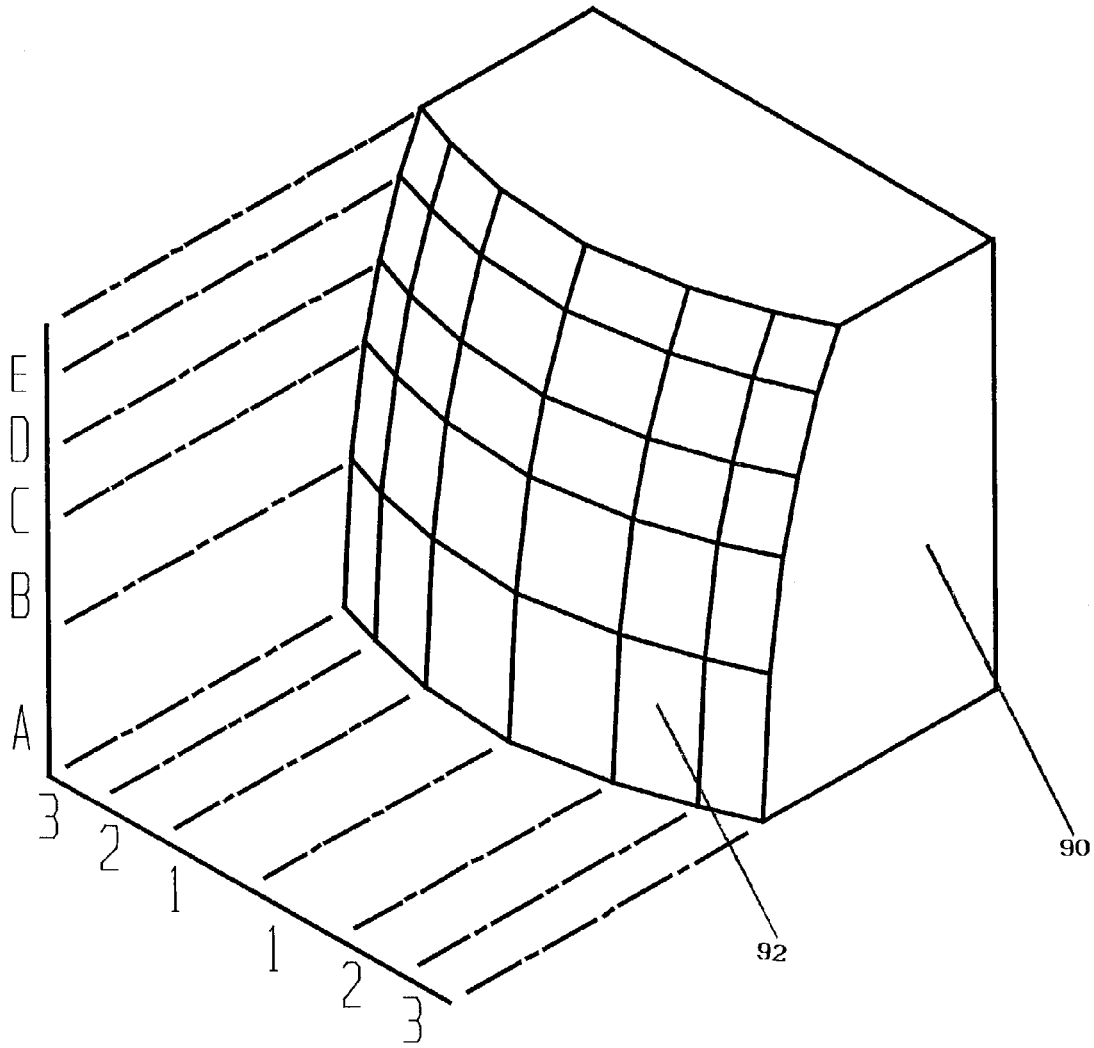
FIG. 7A is a three dimensional cross-section of a cluster.
Figure 7B:
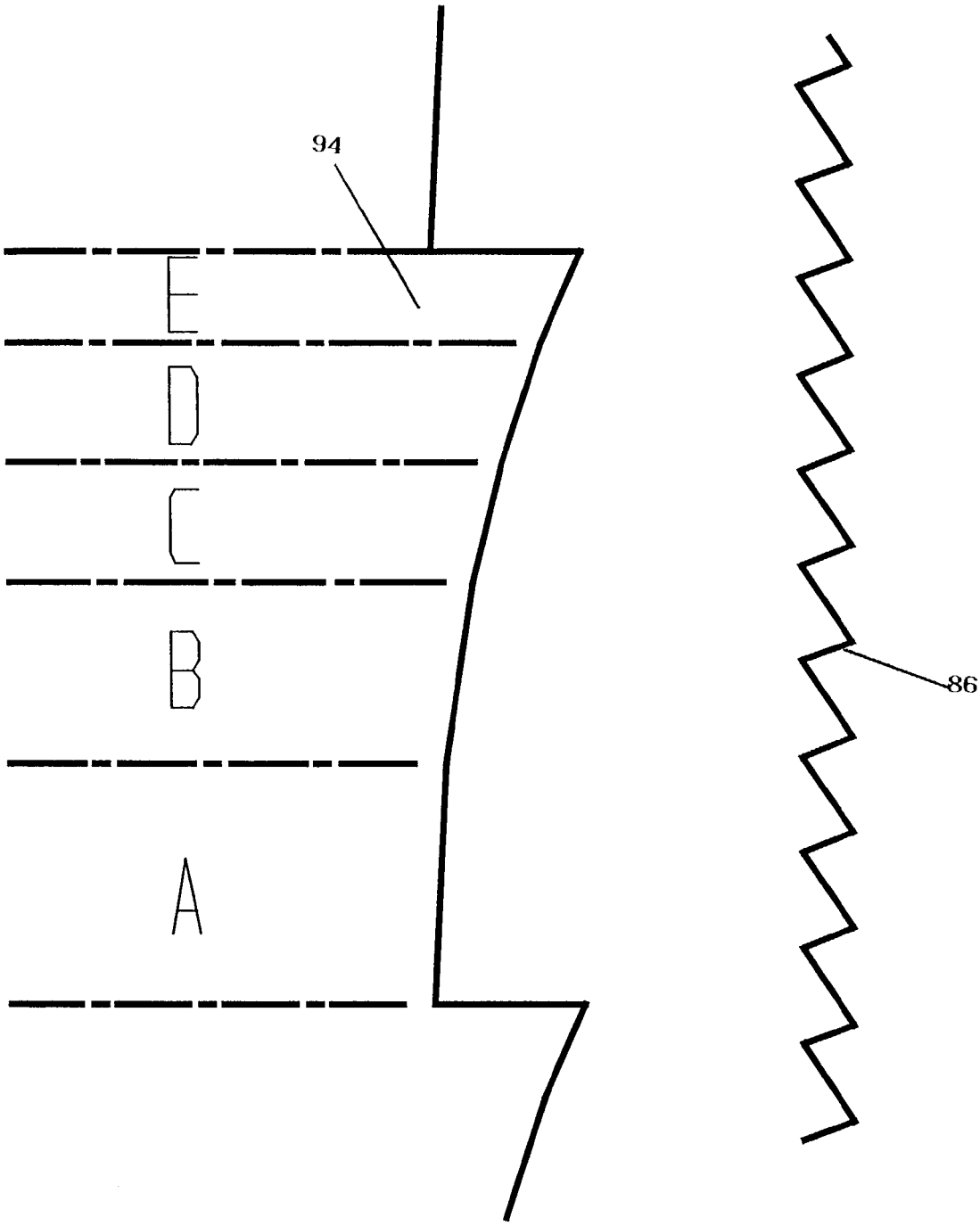
FIG. 7B is a two-dimensional vertical cross-section of a cluster.
Figure 7C:
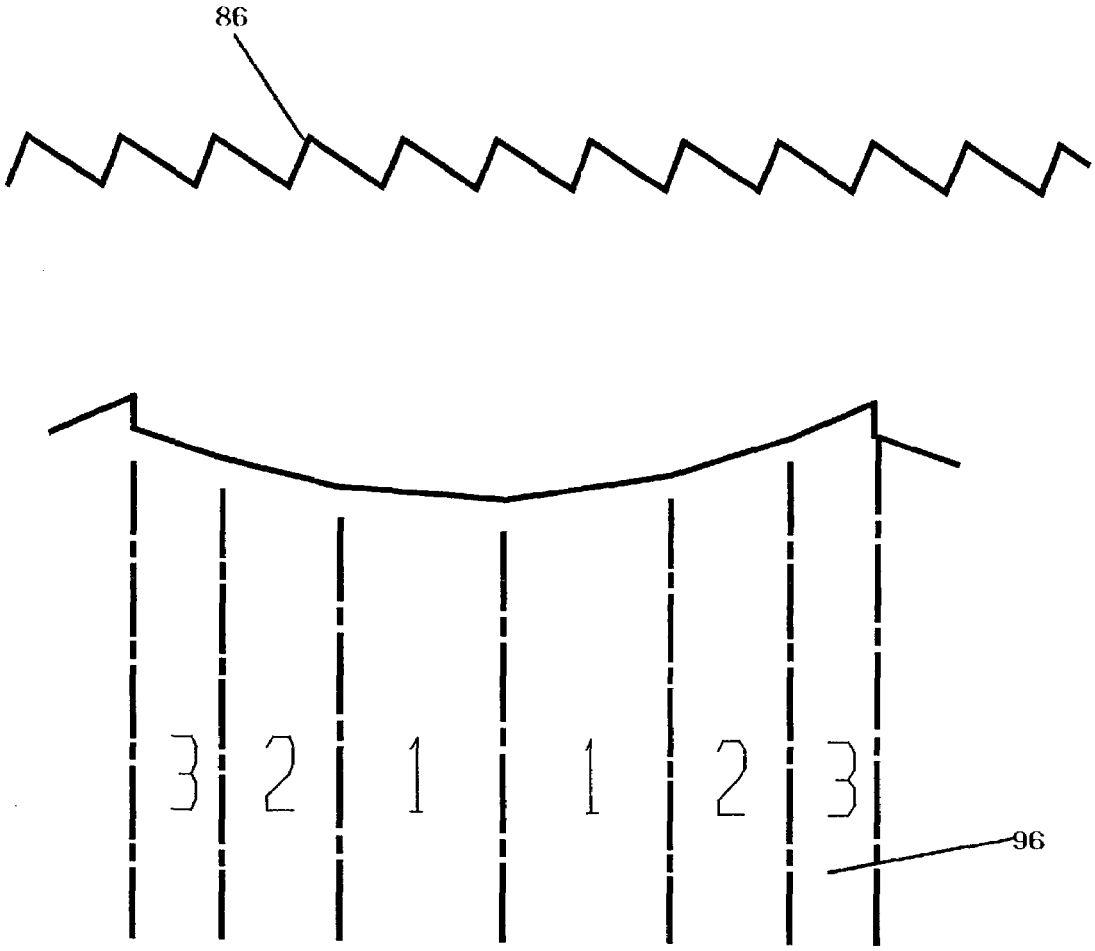
FIG. 7C is a two-dimensional horizontal cross-section of a cluster.
Figure 8A:
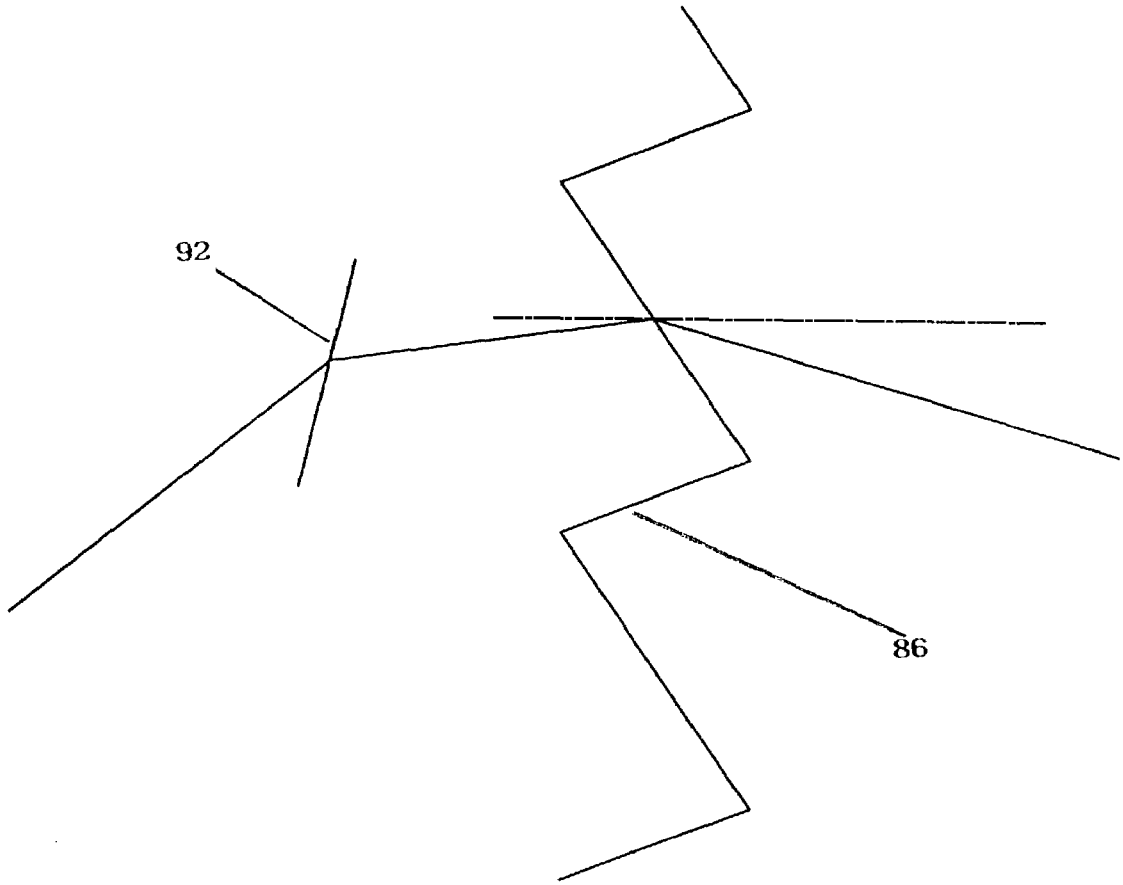
FIG. 8A is the light distribution through the cluster of FIG. 7A.
Figure 8B:
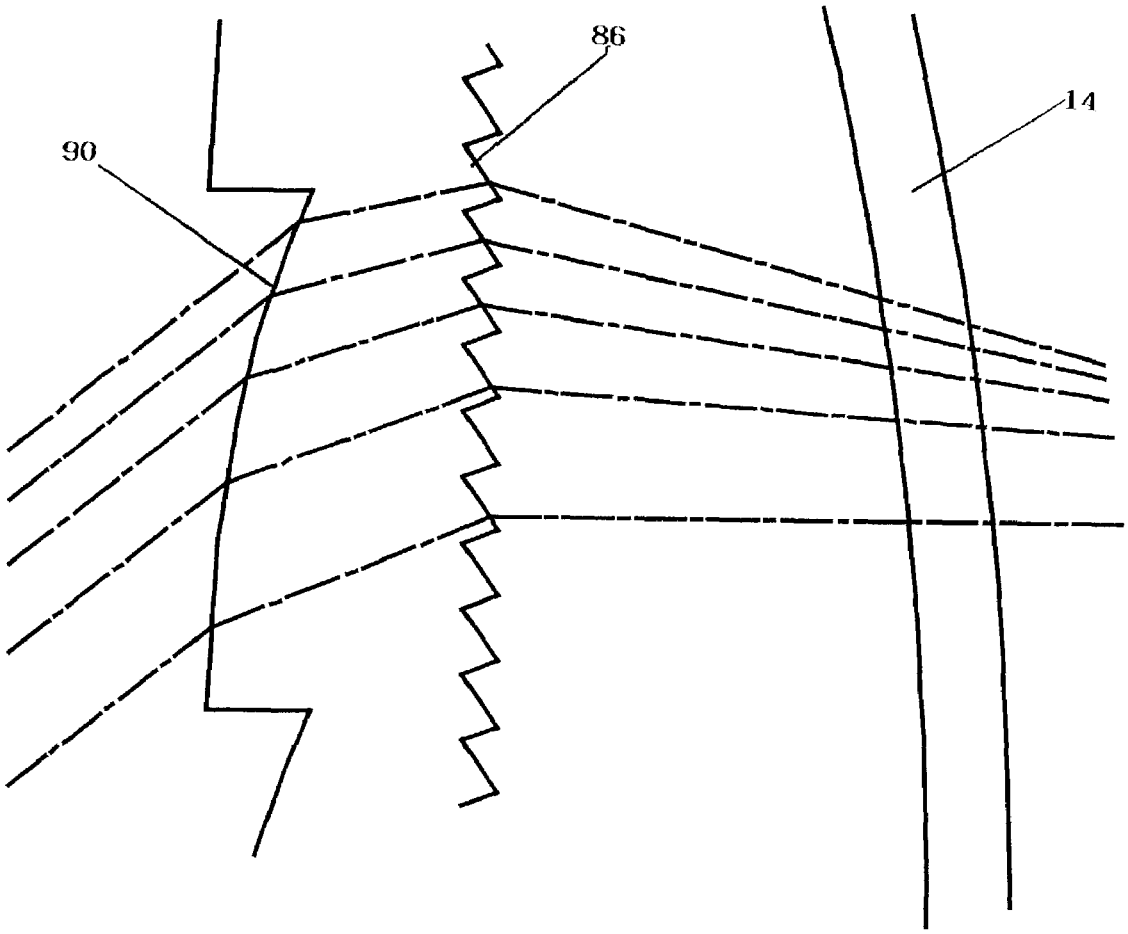
FIG. 8B is the light distribution through the cluster of FIG. 7B.

Referring to FIGS. 1 and 2, a signal lamp 10 having a housing is shown. The main components of the signal lamp 10 are shown. A housing holds the components of the signal lamp 10. The housing may be formed from, for example, polycarbonate material. Polycarbonate material has excellent strength and impact resistance characteristics. The housing is designed to be retrofit into existing incandescent traffic light signals. The housing is closed with an optically neutral cover 14.

The housing is made up of a housing base or back cover 22 and the neutral front cover 14. The front cover 14 and the base 22 mate so that the signal light is impervious to water. In one embodiment, the front cover 14 and the base 22 are snap fit together. The front cover 14 has a shoulder 30 with a lip 34. The lip 34 mates with an undercut flange 42 on the base 22. Preferably, there is an O-ring 28 between the front cover 14 and the base 22.

A dust and water-resistant seal is provided by o-ring 28. The o-ring 28, preferably made of EPDM material, is sized to elastically fit between housing shoulder 30 and the rim 38 of the optical element. In addition to providing the closure seal between the cover 14 and housing base 22, the o-ring 28 provides a shock dissipation function for impacts upon the cover 14 during use.

The front cover 14 is preferably a transparent, optically neutral shell. In an alternative embodiment, the cover 14 can be tinted. In another embodiment, the cover 14 has texture over at least part of its internal or external surface.

In some application, where watertightness and/or dust protection are not an issue, it may desirable to use the optical element in a system in which there is no cover. For example, in indoor application such as for signs, there may be no need to protect the optics from water and/or dust and thus a signal could be made without a cover. This would result in materials cost saving and manufacturing savings due to fewer parts.

The present invention may be easily retrofitted into an existing traffic signal upon removal of the original outer lens and incandescent lamp. The housing outer rim may be designed to have the same size as the lens it replaces. Power connection of the retrofitted light may be performed, without requiring an electrician.

The housing also contains the power supply 24 which power the LEDs 18. The power 5 supply 24 is connected to a PCB 16 by wires 110. Preferably, the power supply 24 is mounted in the housing base 22. In the preferred embodiment, the power supply 24 fits into a slot 58 in the base 22 of the housing. The power supply 24 connects to blades 60 that project through the base 22 of the housing.

The power supply 24 is held in place with a snap retainer 62. The snap retainer 62 holds the power supply 24 in place and ensures electrical contact between the power supply tabs 64 and the overmolded blades 60. Wires 56 can quickly connect to tabs 64.

Blades 60 are overmolded with the base 22. Wires 56 are used to connect the blades 60 to a terminal block. The blades 60 and wires 56 are protected from the elements by a cap 66 that mates with the base 22. The cap 66 connects to the base 22 with a screw 70. The cap 66 prevents the wires 56 from being pulled out and from accidental disengagement with the blades 60. The cap 66 is watertight. A small hole by the head of the screw 70 allows for pressure changes. As the pressure changes, air can escape or enter through the screw threads.

The above invention is optimized for high output LEDs 18. As higher output LEDs 18 become available, fewer LEDs 18 will be required to obtain the same light output.

Inside the housing is the metal core PCB 16 with at least one LED 18 surface mounted to it. The light from the LEDs 18 is controlled by a substantially planar optical element 20. Preferably, the light is controlled independently of the footprint of the LEDs 18. Prior art signals use LED spacing, LED footprint, LED location, a fresnel 230 lens to collimate the light and a distributive cover 232 on the housing to control the light. In prior art signals the light is collimated and then distributed.

The PCB 16 is in contact with a heat sink 46 to improve the heat exchange with the air. In the preferred embodiment the heat sink 46 is substantially larger than the PCB 16. In the preferred embodiment, the heat sink 46 has a flat portion 48 and two wings 50. In an alternative embodiment, the PCB 16 is substantially the same size as the heat sink 46 could be used, although this is not preferred because this embodiment would require a larger PCB which increases manufacturing costs. As LED efficiency improves, less heat will be generated by the LEDs. As the efficiency of the LEDs improves, thereby generating less heat, smaller and smaller heat sinks will be required. The efficiency of the LEDs will improve enough that no separate heat sink is required as the PCB alone will be sufficient to dissipate the heat generated by the LEDs.

A ring 76 attaches to the heat sink 46. It is used to secure the PCB 16 with the LEDs 18 to the heat sink 46 and to ensure good thermal interface between the PCB 16 and the heat sink 46. In one embodiment, screws are used to attach the ring to the PCB 16. It is preferable to use a single part such as the ring 76, however several shims (not shown) could be used. Other attachment means, such as snap fit or electrically conductive adhesive could also be used.

An optical element 20 is mounted in the housing. The optical element 20 is mounted perpendicular to and centered on an imaginary central axis 44.

The at least one LED 18 is preferably mounted at the imaginary central axis or if more than one LED 18, they are preferably mounted so that they are substantially centered about the central axis 44.

The planar optical element 20 is shaped to fit the housing. Typically, the optical element 20 is a planar disk. Although other shapes are possible.

The optical element 20 has a rim 38 with notches 78 that align with notches 80 in the base 22. This allows the optical element 20 to be quickly and easily placed in a desired orientation.

Figure 9:
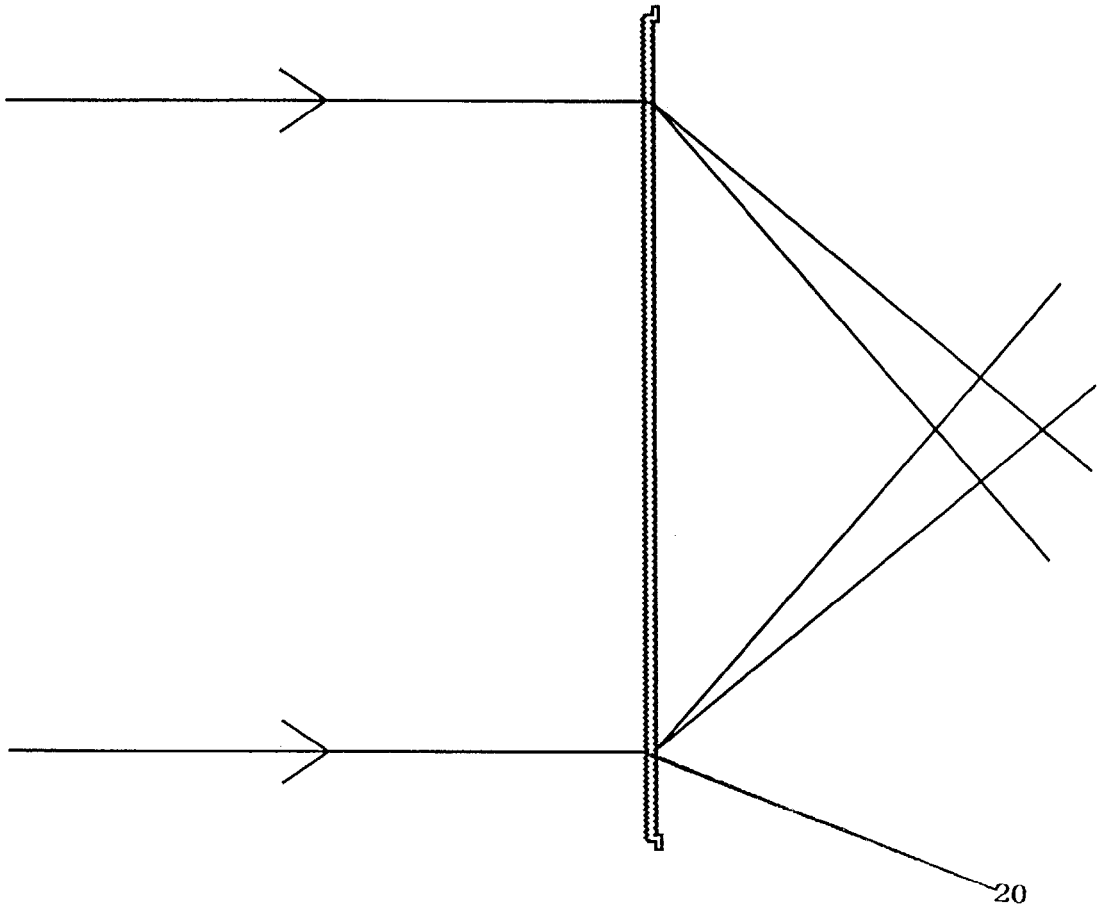
FIG. 9 is a ray diagram of collimated light through the optical element.
Figure 10:
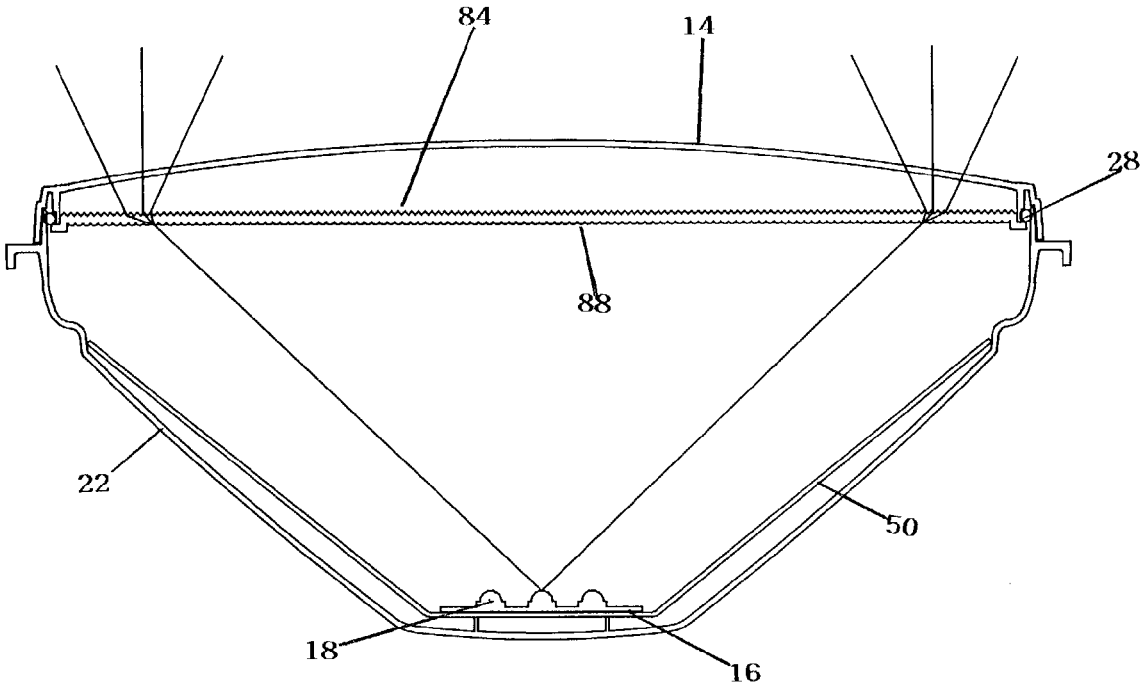
FIG. 10 is a ray diagram of light from the LEDs through the optical element.
Figures 11, 12:
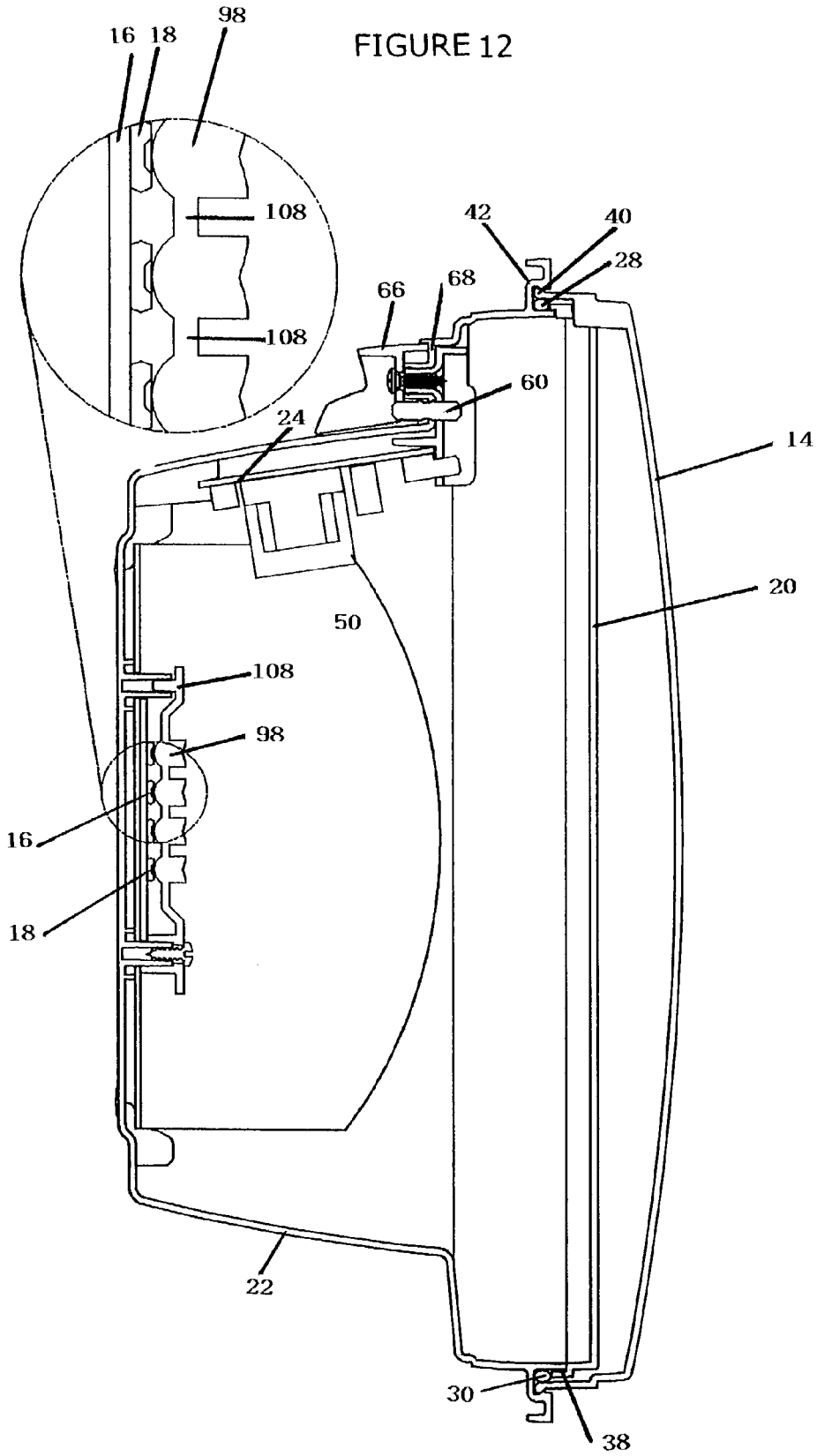
FIG. 11 is an alternative embodiment of the present invention with a lens to shape the light placed in front of the LEDs.
FIG. 12 is a detail cross-section of the LEDs and lens.
Figure 14A:
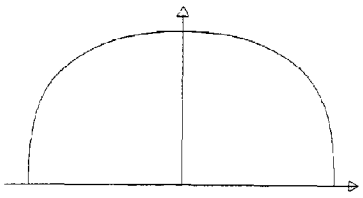
FIGS. 14A–14D are shaped light patterns for FIGS. 13A–13D, respectively.

The optical element 20 controls the light by distributing the light before it is collimated. FIG. 9 shows the path of collimated light incident upon the inventive optical element. The light incident upon the distributing surface comes from a variety of directions. FIG. 10 shows the path of light emitted by the LEDs 18 incident upon the optical element. The light is distributed and then collimated.

As can be seen in FIGS. 15–20, prior art systems collimate the light with a collimating surface 230 such as a fresnel lens and then distribute the collimated light with a distributive surface 232. The distributive surface is symmetrical because the incident light has been collimated. Prior art systems using only a distributive surface to control the light have LEDs all over the signal and thus the distributive texture is repetitive.

The optical element comprises a first optical surface 88 on the side closest to the LEDs 18 and a second optical surface 84 away from the LEDs 18.

The second optical surface 84 is preferably a fresnel lens 86. However, the second optical surface 84 can be any desired optical surface.

The first optical surface 88 comprises a plurality of clusters 90. Preferably, each cluster 90 is approximately ¼-inch by ¼-inch. Each cluster 90 comprises a plurality of faces 92. Each face 92 is shaped on the horizontal and vertical axis to control the light. As a result, each face 92 has an angle and a size. Preferably, the faces 92 in a cluster 90 are an approximation of the faces needed to control the light, so that each cluster 90 is a smooth, continuous surface that is shaped on the x-, y-, and z-axis. Preferably, but not necessarily, the first optical surface is symmetrical left and right of a vertical midline through the central axis 44 to generate a symmetrical beam. Depending on the application, the adaptive texture of the distributive surface could be asymmetrical to generate an asymmetrical beam.

Each cluster 90 is different. Because the optical element distributes the light before it is collimated, the angle of light incident on each area on the optical element is different and requires a different cluster to control the light. Typically, an efficient uniform signal is desired.

In determining the shape of each cluster, the angle and the size of each face 92 is calculated. The desired light output, target direction, the shape, location and optical properties of the second surface 84 of the optical element 24, the location of the cluster 90 relative to the LEDs 18, and the central axis 44 are known. The ideal shape and angle of each face 92 in a cluster 90 is determined such that light will be emitted in the target direction and in the desired amount. The ideal angle and size of each face in a cluster is used to machine or mold a cluster surface that is an approximation of the ideal faces. Each cluster has a continuous smooth surface and which controls the light. Each individual cluster 90 is not symmetrical about any particular axis. In calculating the angle, size and shape of each face, it is necessary to take into account that the LEDs have a footprint and are not a point source.

The smaller each cluster 90 is, the more even the thickness of the optical element 20 can be. It is desirable to make the optical element 20, as thin as possible so it can be produced by injection molding. Additionally, a thin optical element 20 uses less material. However, there are limits as to how thin the optical element can be. If the clusters 90 are too small, the optics are difficult to machine. Additionally, if the clusters 90 are too small unwanted shadows are visible.

Different LED manufacturers provide LEDs with distinctive light patterns. It is advantageous to change the light pattern of the LEDs so that different LEDs can be used without adversely affecting efficiency and/or the uniformity of the signal. It also may be desirable to have certain light patterns in certain applications. Thus, a lens 98 can be placed over each LED 18 to change the light pattern.

For example, the lens 98 on top of the LEDs 18 could be used to change the light pattern from a lambertian pattern to a batwing pattern. A batwing pattern is useful in certain applications or to generate a uniform signal.

It is desirable to illuminate the entire optical element with a uniform signal, but no more. Thus, the optical element is preferably placed at a distance from the LEDs that allows maximum illumination of the cover with a minimum, or preferably no light lost by illuminating areas other than the optical element.

In some situations, the spread of the LEDs is too wide and light is lost. To combat this, lensing can optionally be placed over the LEDs to adjust the light pattern to illuminate the entire optical element, but only the optical element, with a uniform signal.

Figure 13A:
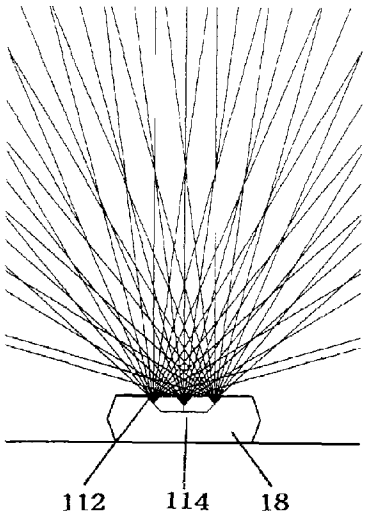
FIGS. 13A–13D are ray diagrams for light emitted from an LED.
Figure 14B:
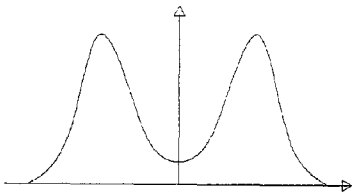
Figure 13B:
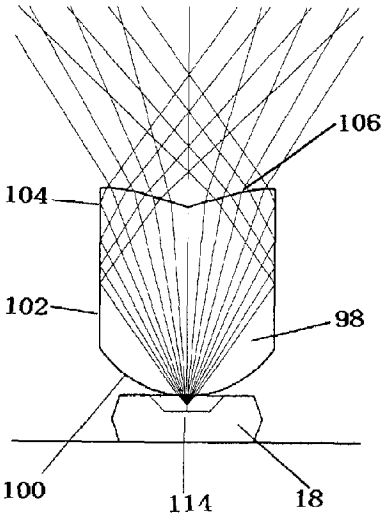
Figure 14C:
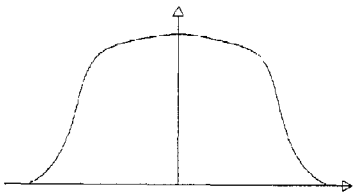
Figure 13C:
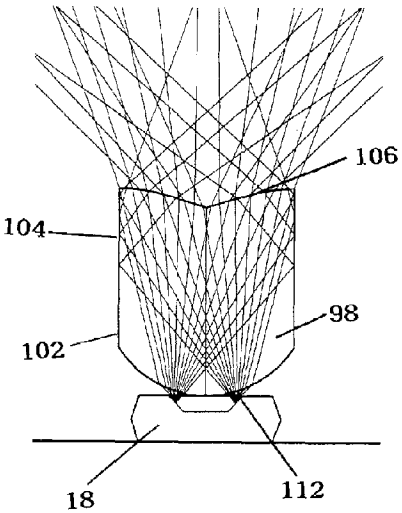
Figure 14D:
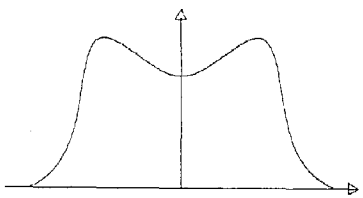
Figure 13D:
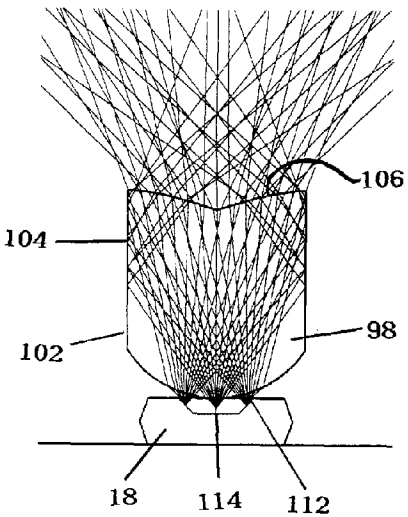
Figure 15:
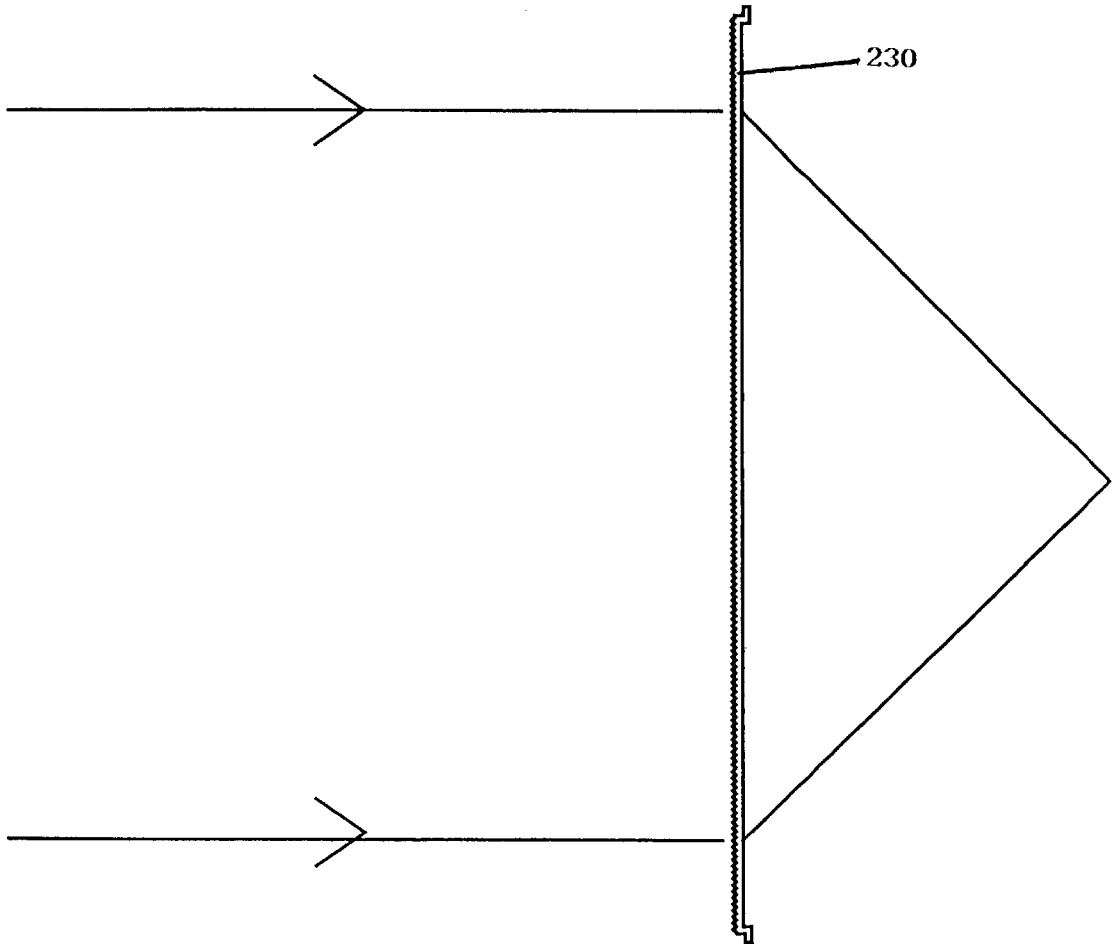
FIGURE 15 PRIOR ART
FIG. 15 is a prior art ray diagram for light transmitted by a positive lens.
Figure 16:
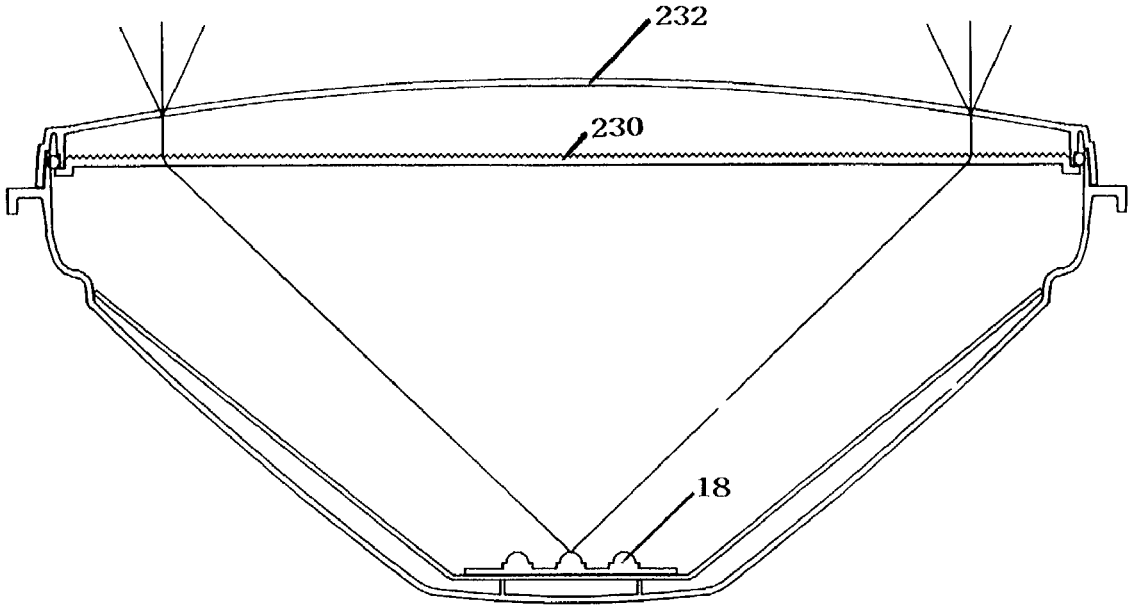
FIGURE 16 PRIOR ART
FIG. 16 is a prior art ray diagram of light emitted from an LED.
Figure 17:
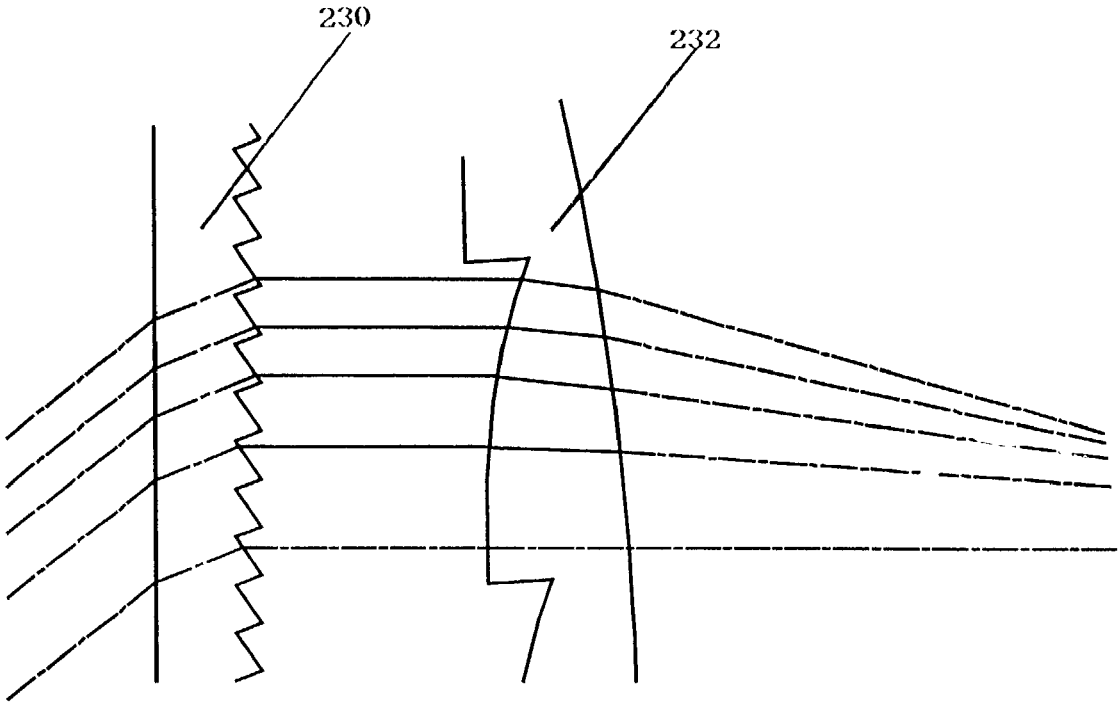
FIGURE 17 PRIOR ART
FIG. 17 is a detailed ray diagram showing the lens and distributive cover of FIG. 16.
Figure 19:
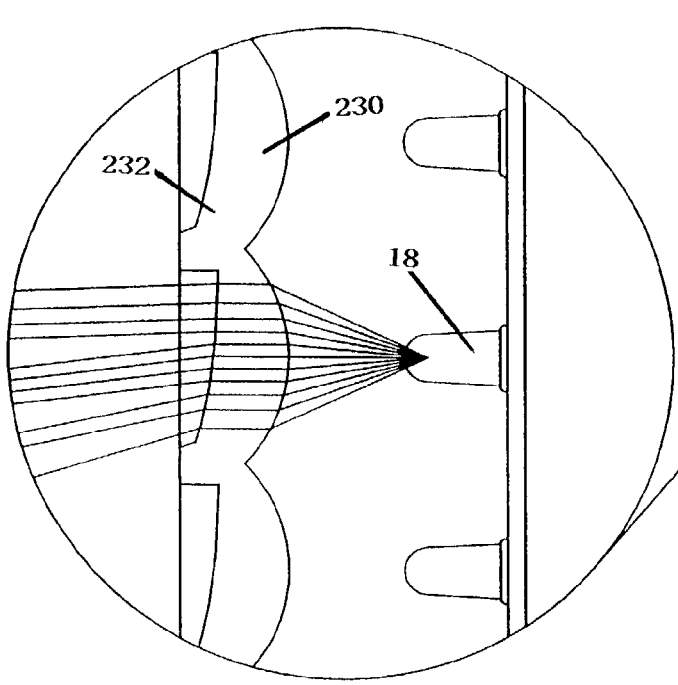
Figure 19 PRIOR ART
FIG. 19 is a detailed view of FIG. 18.
Figure 18:
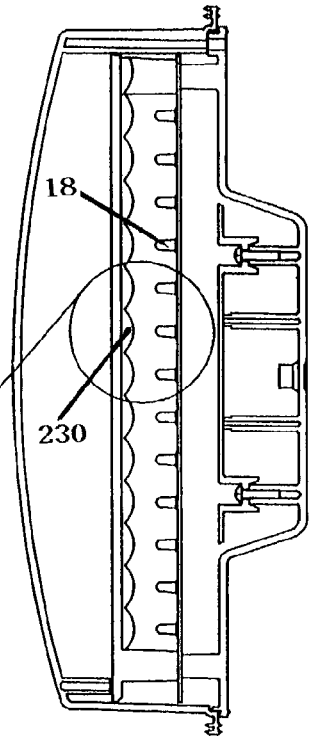
Figure 18 PRIOR ART
FIG. 18 is a prior art LED signal.
Figure 20:
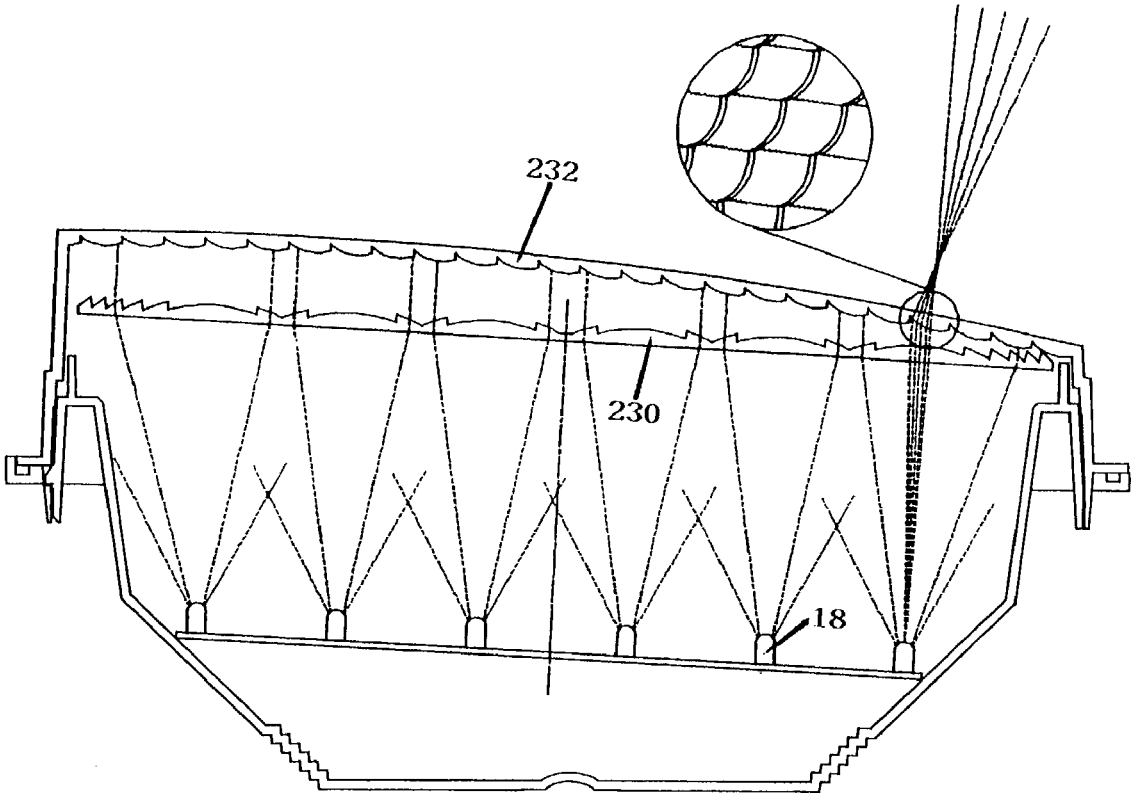
FIGURE 20 PRIOR ART
FIG. 20 is a prior art LED signal.

FIG. 13A shows an LED with a wide light pattern. If an optical element were placed in front of this light pattern, not all the light would be incident on the optical element. To minimize light loss, lensing 98 can be placed over the LED to adjust the light pattern, as can be seen in FIGS. 13B–13D.

A series of interconnected lenses 98 is placed over the LEDs 18. Each LED 18 has an individual lens 98 placed over it. Preferably, the lenses are made of plastic and linked together with an integral plastic carrier 108. The lens shapes the light at three points: the entry face 100, a total internal reflection face on the side of the lens 104, and the exit face 106.

Light from an LED has two general emission points. The first is direct from the LED chip 18 and the second is redirected by the "cup" 112 of the LED.

The light emitted by the LED chip 114 enters the lens 98 at the entry face 100. The entry face 100 is shaped such that light is directed to the upper portion 104 of the side which is a total internal reflection surface or to the exit face 106. The entry face 100 directs the light away from the lower portion 102 of the side. This reduces the loss of light. The plastic carrier 108 interconnecting the lenses 98 is preferably formed at the lower portion 102 of the side. Thus, if light were incident upon the lower portion 102, the carrier 108 would act as a light pipe. By directing light away from this area, one minimizes the light loss and increases the efficiency of the signal.

FIG. 13B shows the light emitted from the LED 18 chip 114. The light is directed by the entry face 100 of the lens 98 away from the lower portion 102 of the side and toward the upper portion 104 of the side where the light is reflected to the exit face 106 due to total internal reflection.

FIG. 13C shows light redirected by the cup 112 of the LED 18 toward the lens 98. The entry face 100 directs the incident light toward the upper portion 104 of the side. The light is redirected through total internal reflection to the exit face 106.

FIG. 13D shows light directly from the LED 18 chip and redirected by the cup 112 of the LED incident upon the entry face 100 of the lens 98. The light is directed onto the upper portion 104 of the side so that the light will be reflected onto the exit face 106.

When FIGS. 13A and 13D are compared, the adjusted light pattern can be seen. It is preferable to have an efficient light pattern that maximizes the light incident on the optical element. It is also preferably that the LED have a batwing light pattern so a uniform signal will be generated.

Information and/or directional signals may be created by masking portions of the cover 14 into, for example, turn signal arrows.

A variation of the housing, using otherwise similar components may be used to create stand alone signals or even general illumination light sources useful, for example, when it is foreseen that the light source will be located where maintenance will be difficult and an extreme service interval is desired.

Further, although particular components and materials are specifically identified herein, one skilled in the art may readily substitute components and/or materials of similar function without departing from the invention as defined in the appended claims.

The present invention is entitled to a range of equivalents, and is to be limited only by the following claims.

The invention claimed is:

1. An LED signal comprising:

at least one LED arranged on a metal core PCB, said at least one LED has a footprint;

a substantially planar optical element having a first surface facing toward the at least one LED and a second surface facing away from the at least one LED;

at least one lens placed over said at least one LED; the at least one lens has an entry face, an exit face, and a side; the side has an upper total internal reflection portion and a lower portion;

a carrier formed integrally with said at least one lens at the lower portion of said at least one lens wherein the lens controls light emitted from the LED at the entry face, the exit face and the upper total internal reflection surface; and said optical element having an optical surface on the second surface and a diffusing surface on the first surface, wherein said diffusing surface comprises a plurality of clusters and said optical surface collimates LED light diffused by said diffusing surface.

2. The LED signal of claim 1, wherein said optical element controls the light that exits the second surface.

3. The LED signal of claim 1, wherein the optical surface is a fresnel lens.

4. The LED signal of claim 2, wherein each cluster has a continuous shaped surface that approximates a plurality of faces.

5. The LED signal of claim 4, wherein said plurality clusters are symmetrical about a vertical midline of the optical element.

6. The LED signal of claim 4, wherein at least one cluster is asymmetrical.

7. The LED signal of claim 4, wherein substantially all the clusters are asymmetrical.

8. The LED signal of claim 4, wherein substantially all the clusters are different.

9. The LED signal of claim 6, wherein said optical element is centered on a central axis of said LED signal and the footprint of the at least one LED is substantially aligned with the central axis.

10. The LED signal of claim 9, wherein the optical surface collimates the light.

11. The LED signal of claim 10, wherein the optical surface is a fresnel lens.

12. The LED signal of claim 1, wherein the entry face is curved and directs the light away from the lower portion.

13. The LED signal of claim 1, further comprising a plurality of LEDs wherein the means for adjusting the radiation pattern further comprises a plurality of lenses each lens placed over one LED, and the carrier is formed integrally with the plurality of lenses.

14. The LED signal of claim 1, wherein said signal further comprises a means to dissipate heat and said means to dissipate heat is selected from the group consisting of a heat sink, a heat diffuser, a heat exchanger, the PCB or a combination thereof.

15. The LED signal of claim 14, wherein said means to dissipate heat is a heat sink.

16. The LED signal of claim 15, wherein the heat sink is substantially larger than said metal core PCB.

17. The LED signal of claim 1, wherein the means to dissipate heat is the metal core PCB.

18. The LED signal of claim 1, wherein the LED signal further comprises a second diffusing surface arranged such that light transmitted by the optical element is incident upon the second diffusing surface.

19. An LED signal comprising:

at least one LED arranged on a metal core POB, said at least one LED has a footprint;

a substantially planar optical element having a first surface facing toward the at least one LED and a second surface facing away from the at least one LED;

said optical element having an optical surface on the second surface and a diffusing surface on the first surface, wherein said diffusing surface comprises a plurality clusters;

at least one lens placed over said at least one LED;

the at least one lens has an entry face, an exit face, and a side; the side has an upper total internal reflection portion, and a lower portion;

a carrier formed integrally with said at least one lens at the lower portion of said at least one lens;

wherein the lens controls light emitted from the LED at the entry face, the exit face and the upper total internal reflection surface;

a housing comprising a cover and a base, said base having an interior area and an open end, and said at least one LED is located within said interior area and said cover closes said open end.

20. The LED signal of claim 19, wherein said optical element controls the light that exits the second surface.

21. The LED signal of claim 20, wherein each cluster has a continuous shaped surface that approximates a plurality of faces.

22. The LED signal of claim 21, wherein said plurality clusters are symmetrical about a vertical midline of the optical element.

23. The LED signal of claim 21, wherein at least one cluster is asymmetrical.

24. The LED signal of claim 21, wherein substantially all the clusters are asymmetrical.

25. The LED signal of claim 21, wherein substantially all the clusters are different.

26. The LED signal of claim 23, wherein said optical element is centered on a central axis of said LED signal and the footprint of the at least one LED is substantially aligned with the central axis.

27. The LED signal of claim 19, wherein the entry face is curved and directs the light away from the lower portion.

28. The LED signal of claim 19, further comprising a plurality of LEDs wherein the means for adjusting the radiation pattern further comprises a plurality of lenses each lens placed over one LED, and the carrier is formed integrally with the plurality of lenses.

29. The LED signal of claim 19, wherein said signal further comprises a means to dissipate heat and said means to dissipate heat is selected from the group consisting of a heat sink, a heat diffuser, a heat exchanger, the PCB or a combination thereof.

30. The LED signal of claim 29, wherein said means to dissipate heat is a heat sink.

31. The LED signal of claim 30, wherein the heat sink is substantially larger than said metal core PCB.

32. The LED signal of claim 29, wherein the means to dissipate heat is the metal core PCB.

33. The LED signal of claim 19, wherein said LED signal further comprises power supply components and circuitry.

34. The LED signal of claim 19, wherein said LED signal is adapted to be retrofit into an existing traffic light.

35. The LED signal of claim 19, wherein said cover attaches to said open end by a means for attachment.

36. The LED signal of claim 35, further comprising a sealing means to environmentally seal LED signal.

37. The LED signal of claim 36, wherein said sealing means is an O-ring.

38. The LED signal of claim 19, wherein the LED signal further comprises a second diffusing surface arranged such that light transmitted by the optical element is incident upon the second diffusing surface.

39. The LED signal of claim 38, wherein the second diffusing surface is the cover.

40. The LED signal of claim 19, wherein the cover is a neutral cover.

41. The LED signal of claim 19, wherein the cover is textured.

42. The LED signal of claim 19, wherein the cover is tinted.

43. The LED signal of claim 19, wherein the cover is clear.

* * * * *